US007614614B2

(12) United States Patent
Sabadicci et al.

(10) Patent No.: US 7,614,614 B2
(45) Date of Patent: Nov. 10, 2009

(54) VENTURI APPARATUS

(75) Inventors: Rio Sabadicci, Carlsbad, CA (US); Larry D. Nelson, Carlsbad, CA (US)

(73) Assignee: Exica, Inc., Carlsbad, CA (US)

( * ) Notice: Subject to any disclaimer, the term of this patent is extended or adjusted under 35 U.S.C. 154(b) by 459 days.

(21) Appl. No.: 11/354,490

(22) Filed: Feb. 15, 2006

(65) Prior Publication Data

US 2007/0187848 A1 Aug. 16, 2007

(51) Int. Cl.
*B01F 3/04* (2006.01)

(52) U.S. Cl. ..... 261/76; 261/DIG. 75; 426/474

(58) Field of Classification Search ..... 261/76, 261/DIG. 75; 99/323.1; 426/474
See application file for complete search history.

(56) References Cited

U.S. PATENT DOCUMENTS

| | | | | | |
|---|---|---|---|---|---|
| 3,704,008 | A | * | 11/1972 | Ziegler | 261/25 |
| 3,774,645 | A | | 11/1973 | Pompa | |
| 4,308,138 | A | * | 12/1981 | Woltman | 210/220 |
| 4,564,480 | A | * | 1/1986 | Kamelmacher | 261/36.1 |
| 4,595,121 | A | | 6/1986 | Schultz | |
| 4,640,782 | A | * | 2/1987 | Burleson | 210/748 |
| 4,721,562 | A | * | 1/1988 | Barnscheidt et al. | 209/170 |
| 5,169,293 | A | * | 12/1992 | Yamamoto | 417/179 |
| 5,336,402 | A | * | 8/1994 | Yamamoto et al. | 210/194 |
| 5,403,475 | A | * | 4/1995 | Allen | 210/774 |
| 5,509,349 | A | | 4/1996 | Anderson et al. | |
| 6,162,021 | A | * | 12/2000 | Sarshar et al. | 417/174 |
| 6,290,917 | B1 | * | 9/2001 | Yamamoto | 422/159 |
| 6,450,484 | B1 | * | 9/2002 | Popov | 261/76 |
| 6,568,660 | B1 | | 5/2003 | Flanbaum | |
| 6,581,856 | B1 | | 6/2003 | Srinath | |
| 6,767,006 | B1 | * | 7/2004 | Tripepi | 261/23.1 |
| 6,986,506 | B2 | * | 1/2006 | Chapman et al. | 261/76 |
| 2004/0166000 | A1 | | 8/2004 | Fisher et al. | |
| 2004/0251566 | A1 | * | 12/2004 | Kozyuk | 261/76 |

FOREIGN PATENT DOCUMENTS

| | | |
|---|---|---|
| EP | 0344859 | 12/1989 |
| JP | 10033961 | 2/1998 |
| JP | 2004122043 | 4/2004 |

OTHER PUBLICATIONS

Supplemental European Search Report, Serial No. 07749822, Mar. 2009.

* cited by examiner

*Primary Examiner*—Scott Bushey
(74) *Attorney, Agent, or Firm*—Townsend and Townsend and Crew LLP

(57) ABSTRACT

An improved venturi apparatus for facilitating the mixture of fluid substances. The apparatus preferably has first funnel section operative to receive a fluid and channel the same through a first cylindrical section or passageway. The first cylindrical section is fluidly connected to an intermediate passageway having a diameter larger than the first cylindrical section. At least one sidearm passageway is fluidly connected to the intermediate passageway into which at least one second fluid is introduced. The at least one sidearm passageway is preferably configured to fluidly interconnect with the intermediate passageway at approximately the medial portion of the intermediate passageway. Fluidly connected to the intermediate passageway is a second cylindrical section that is operative to direct the flow of the intermixed fluids to a second exit funnel section. The improved venturi apparatus is exceptionally efficient at drawing in a second fluid and effective in facilitating the mixture of two or more gasses, liquids or combinations thereof.

20 Claims, 2 Drawing Sheets

VENTURI APPARATUS

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention is directed to an improved venturi device, and more particularly, an improved venturi device that is operative to facilitate the mixture of two or more fluids.

Venturi-type devices are well-known in the art. Generally, such devices comprise fittings or tubular structures, and in particular pipe structures, that are constricted in the middle and flared on both ends. When a fluid, such as a gas or liquid, is passed through the venturi, the fluid's velocity of flow is caused to increase whereas the fluid's pressure is correspondingly caused to decrease. Such devices are used in a variety of applications, and especially in measuring fluid flow or for creating suction as for driving aircraft instruments or drawing fuel into the flow stream of a carburetor.

Along these lines, venturi devices are frequently utilized to mix or combine a second fluid (i.e., a liquid or gas) with a fluid passing through the venturi. In this regard, it is well-known that the constriction point of the venturi creates a vacuum that is operative to draw in a liquid or gas. Exemplary of such devices that rely on this principle include those disclosed in U.S. Pat. Nos. 5,509,349 to Anderson, et al., and 6,568,660 to Flanbaum, the teachings of each of which are incorporated by reference.

Despite the well-known principals behind venturi devices, as well as the ability of the same to effectively and selectively facilitate the mixture of two or more fluids, drawbacks currently exist in relation to the inability of such devices to introduce (i.e., draw in) a second fluid to a first fluid passing through the venturi device. In this regard, the velocity of the first or primary fluid passing through the venturi is maximized at the point of tapering, which gives rise to the vacuum enabling the second fluid to be drawn into the fluid flow. However, the venturi's tapered portion, because of its limited size, is operative to reduce the area into which a second fluid can be drawn into the fluid flow. The combined increased speed of the fluid and reduced area can thus preclude the ability of the venturi to draw in a second fluid.

While attempts in the art have been made to facilitate the interaction or mixing between two fluids mixed with one another using a vertical flow effect, such as the fluid mixtures disclosed in U.S. Pat. No. 6,581,856 to Srinath, incorporated herein by reference, these attempts have failed insofar as those types of devices are designed to introduce a second fluid into a first stream of fluid emitted under pressure at high velocity. By virtue of the effects of high pressure and velocity, the ability to interject a second fluid becomes substantially more difficult and often requires that the second fluid itself be forcibly introduced under pressure.

Accordingly, there is a substantial need in the art, for an improved venturi apparatus that modifies the desired flow dynamics of the venturi apparatus to consequently improve the ability of a first fluid passing through the venturi to draw in one or more second fluids such that a resultant mixture is produced having substantially greater homogeneity than conventional venturi devices. There is likewise a need in the art for such a venturi apparatus that is of simple construction, low cost to design and capable of being readily deployed in a wide-variety of applications. There is yet further need for such a device that can be readily utilized with a low or high pressurized fluid flow, as well as for facilitating the mixture of any combination of fluid materials, whether liquid with liquid, gas with liquid or gas with gas combinations.

BRIEF SUMMARY

The present invention specifically addresses and alleviates the above-identified deficiencies in the art. In this regard, the present invention is directed to an improved venturi apparatus that is operative to facilitate the assimilation and mixture of two or more fluids in a manner vastly superior to prior art venturi apparatuses. According to a preferred embodiment, the improved venturi apparatus comprises a plurality of sections defining a fluid passageway. The first section comprises a generally funnel-type, frusto-conical void for receiving a first fluid. Per conventional venturi design, the first funnel section possesses a tapered configuration operative to define a progressively narrowing passageway to thus accelerate fluid velocity. The first section channels the fluid to a first cylindrical section, the latter defining a generally straight, cylindrical passageway. Such section is operative to normalize the flow of the first fluid and thus reduce fluid turbulence. Fluidly connected to the first cylindrical section is an expanded intermediate cylindrical passageway that is configured and dimensioned to be larger in diameter than the first cylindrical section. In this regard, the intermediate passageway is operative to cause the fluid received from the first cylindrical section to experience a slight decrease in pressure, contrary to conventional venturi design.

At least one sidearm passageway is fluidly connected to the intermediate passageway through which at least one second fluid may be introduced. The improved venturi apparatus may include two diametrically opposed sidearm passageways fluidly connected to the intermediate passageway to thus enable a second fluid to be drawn into and introduced with the first fluid or, alternatively, enable a third fluid to be drawn into and introduced with the first and second fluids. Preferably, such sidearm passageways will be operative to fluidly interconnect with the intermediate passageway at approximately the medial portion of the intermediate passageway. Along these lines, to facilitate optimal flow dynamics requires that the sidearm passageways introducing one or more additional fluids will interconnect with the intermediate passageway at a point where the first fluid experiences a slight reduction in pressure.

Extending downwardly from the intermediate passageway is a second cylindrical section that is smaller in diameter relative to the intermediate passageway and operative to receive the first and second fluids and normalize the flow of the same. Descending from the second cylindrical section is a second funnel-type, frusto-conical void defining an exit pathway that enables the fluids to further mix and exit.

The aforementioned sections may be integrated in vertical, horizontal, or angled configurations.

In further refinements of the present invention, the improved venturi apparatus may be incorporated as part of a housing or otherwise formed of a segment of pipe, tubing and/or fitting to thus enable the same to be integrated for a specific application. The improved venturi apparatus of the present invention may further be utilized to facilitate and enhance mixing between all types of fluids, whether the same comprise either gasses, liquids or combinations thereof. By way of example, it is believed that the improved venturi apparatus of the present invention is efficient and effective to facilitate the aeration of wine, especially red wine. A substantial number of other applications will further be readily appreciated by one skilled in the art.

BRIEF DESCRIPTION OF THE DRAWINGS

These and other features and advantages of the various embodiments disclosed herein will be better understood with respect to the following description and drawings.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
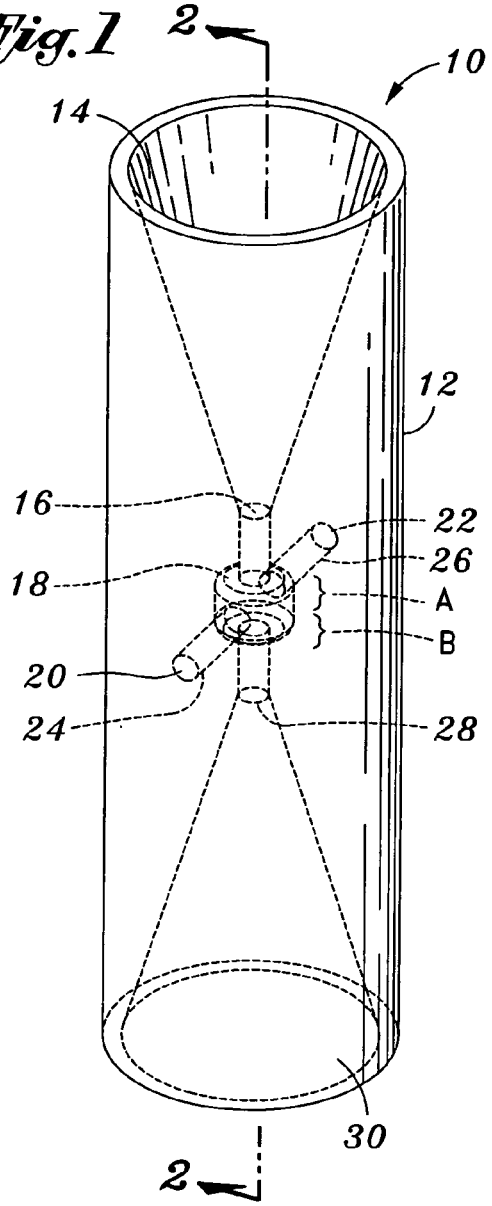
FIG. 1 is an elevated perspective view of a housing incorporating the improved venturi apparatus of the present invention.

Referring now to the figures, and initially to FIG. 1, there is perspectively illustrated an improved venturi apparatus 10 that is operative to facilitate the assimilation and mixture of two or more fluids in a manner that is exceptionally more effective and efficient than prior art methods. At the outset, it should be understood that the term "fluid" as used herein can comprise any fluid-type substance and should be deemed to expressly encompass any type of liquid or gas, as well as materials caused to assume either a liquid or gaseous state as may be caused by the application of either heat and/or pressure, and thus may encompass condensates and vaporized or melted materials. Accordingly, fluids as used herein should be construed as broadly as possible.

The improved venturi apparatus 10 preferably comprises a plurality of sections, namely, a first funnel section 14, first cylindrical section 16, intermediate passageway 18, at least one and preferably two sidearm passageways 24, 26, second cylindrical section 28 and second funnel section 30, all of which are discussed more fully below, that collectively define a sequential path or passageway through which at lease one first fluid is caused to flow through and by which at least one second fluid, via its introduction through passageways 24, 26, is drawn into intermediate passageway 18 and thereafter combine and exit the apparatus via second cylindrical section 28 and second funnel section 30, the latter being operative to facilitate mixing and attaining the desired homogeneity.

Figure 2:
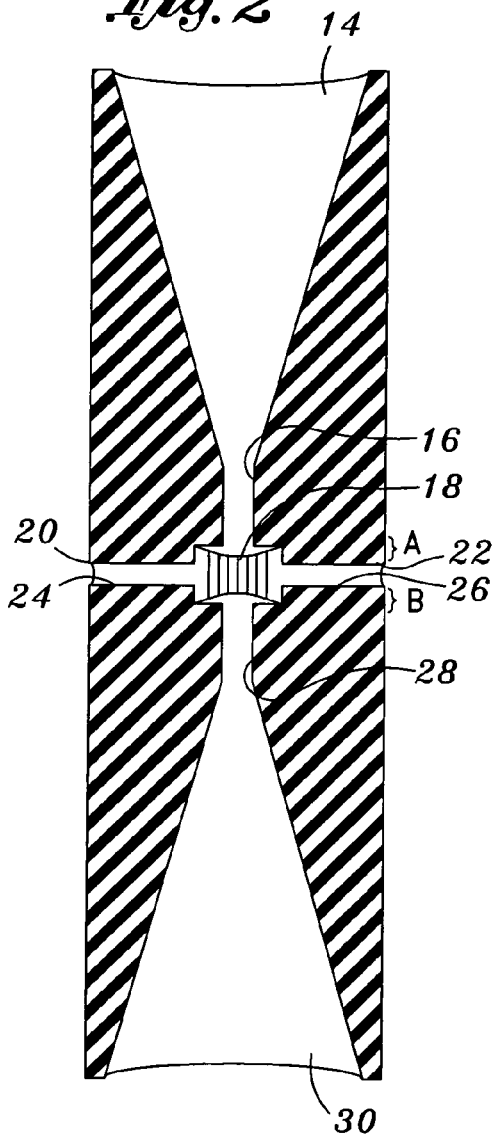
FIG. 2 is a cross-sectional view taken along line 2-2 of FIG. 1.

To achieve the desired effects herein described, there is shown in FIG. 2 the arrangement of the various sections of the improved venturi apparatus of the present invention. As illustrated, first funnel section 14 defines an opening for receiving a first fluid. As will be understood by those skilled in the art, the first fluid may comprise either a single fluid or a mixture of fluids. In any event, the fluid introduced into first section 14, per conventional venturi design, creates a narrowing of the fluid flow path, thus creating an increase in the first fluid's velocity and decrease of the first fluid's pressure.

The first fluid then passes from the first section 14 to a first straight, cylindrical or tubular section 16 as shown. Such first cylindrical section 16 is operative to normalize the flow of the first fluid passing from the first funnel section 14 and consequently reduces fluid turbulence. The first fluid is then sequentially introduced to intermediate passageway 18. As illustrated, intermediate passageway 18 defines a chamber having a diameter greater than that of the first cylindrical section 16, and is provided with a floor and ceiling as well as a mid section having a diameter substantially greater than the first cylindrical section 16 and second cylindrical section 28. As a consequence of having a greater diameter, the first fluid passing from the first cylindrical section 16 to the intermediate passageway 18 experiences a slight decrease in pressure, unlike conventional venturi devices. By virtue of the fluid flow into the intermediate passageway 18, a vacuum force is created that causes a second fluid to be drawn into the intermediate passageway 18 via one or both sidearm passageways 24, 26, as shown. As will be recognized by those skilled in the art, the improved venturi apparatus 10 of the present invention need only be provided with one sidearm passageway to allow for the introduction of a second fluid or, alternatively, may be provided with three or more channels to enable either a greater volume of a second fluid to be drawn into the intermediate passageway 18 or, alternatively, can serve as inlets to enable a third, fourth, fifth or more fluids to be selectively introduced into the intermediate passageway 18. Accordingly, although depicted in FIG. 2 as having two diametrically opposed sidearm passageways 24, 26, and dedicated openings 20, 22, through which at least one second fluid may be introduced, various design changes and modifications of the passageway design will be readily appreciated by those skilled in the art.

Figure 3:
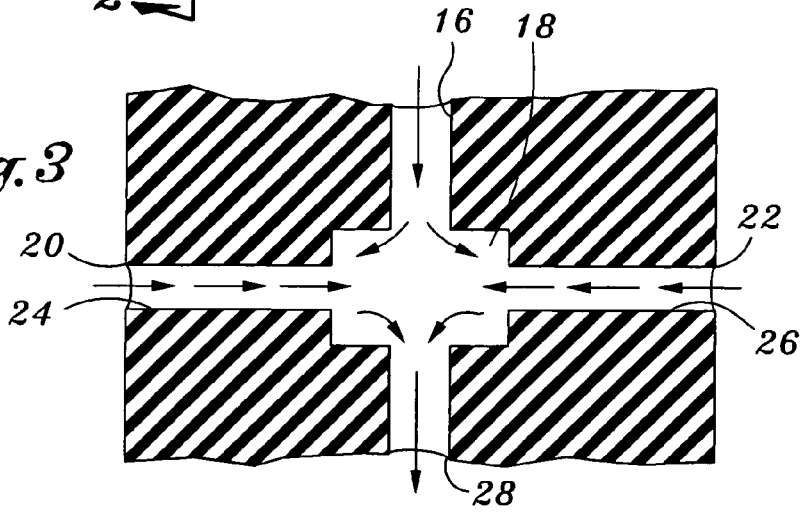
FIG. 3 is a cross-sectional view illustrating the intermediate passageway and passageways fluidly coupled therewith of the improved venturi apparatus of the present invention for facilitating the mixture between a first fluid and a second fluid.
Figure 2A:
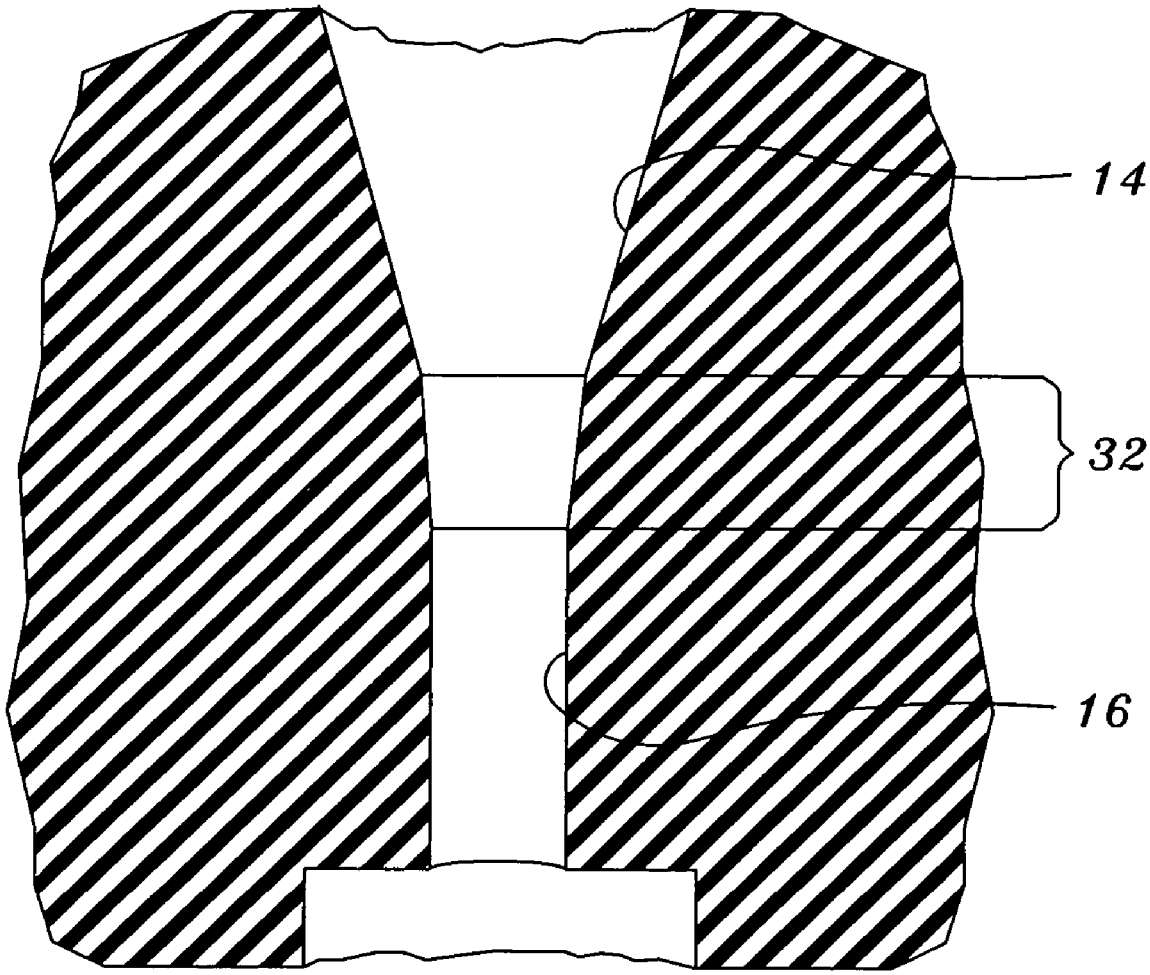

According to a preferred embodiment, at least one or all of the sidearm passageways 24, 26, will be configured such that the same are fluidly connected to the intermediate passageway 18 at generally the median or mid section thereof. Along these lines, and as more clearly illustrated in FIG. 3, sidearm passageways 24, 26, interconnect with intermediate passageway 18 at a point below the ceiling of the intermediate passageway 18, represented by "A" and a distance above the floor of the intermediate passageway 18 represented in FIG. 2 by "B". In a most highly preferred embodiment, distances, "A" and "B" will be equal. Currently, however, it is known that some distance must exist between the ceiling of the intermediate passageway 18 and the sidearm passageway or passageways 24, 26, utilized to introduce the second fluid in order to achieve optimum intermixing of fluids as discussed more fully herein. To the extent the passageways 24, 26, are aligned with the ceiling of the intermediate passageway 18 (i.e., the distance represented by "A" is 0), it is believed that the ability to optimally draw in a secondary fluid will be suboptimal and hence the ability to attain superior mixing by the improved venturi apparatus of the present invention will be suboptimal.

By so arranging the interconnection between sidearm passageways 24, 26, and intermediate passageway 18, the second fluid is thus drawn into and allowed to mix with the first fluid passing into the intermediate passageway 18 in a manner substantially superior to that of prior art devices. Quite unexpectedly, it is believed that by configuring the intermediate passageway 18 to have a greater diameter relative to both first and second cylindrical sections 16, 28 coupled with the introduction of at least one second fluid at substantially the mid portion of the intermediate passageway 18, there is thus produced a substantially more thorough interaction between the fluids to thus create a resultant mixture having a higher degree of homogeneity relative the mixing of fluids via conventional venturi devices.

Following the commingling of the first and second fluids in intermediate passageway 18, the resultant combination is then caused to pass downwardly via second cylindrical section 28 that, similar to first cylindrical section 16, is operative to normalize fluid flow. Thereafter, the combination of fluids is caused to thoroughly intermix and exit via second funnel section 30 per conventional venturi devices. Along these lines, such second funnel section 30 facilitates the mixture between the fluids as the same undergo a decrease in velocity and an increase in pressure.

In order to attain optimal functioning of the improved venturi of the present invention, a chamfer or bevel should be provided at the point interconnecting adjacent sections, 14 and 16 of the improved venturi 10. In this regard, it is believed that this smooth rounded transitional surface is operative to facilitate fluid flow and minimize turbulence and disruptions. To fabricate such contoured surfaces will be easily understood by those skilled in the art and that any type of material, whether it be glass, plastic and/or metal can be readily utilized to fabricate the improved venturi devices disclosed herein.

As will further be readily appreciated by those skilled in the art, a variety of dimensions can be utilized in each of the various sections of the improved venturi apparatus of the present invention for use in a given application. In one specific embodiment exceptionally effective in facilitating the aeration of wine, especially red wine, it is believed that the following dimensions are ideal: the first cylindrical section 14 will have a conical shape of any length tapering to 4.9 mm with a sharp reduction in 1.8 mm height to 4.7 mm, known as a chamfer or bevel (not shown); first cylindrical section 16 will have a constant diameter of 4.7 mm and a length of at least 3.6 mm; intermediate passageway 18 will have a diameter of 6.3 mm and a height of approximately 5 mm; two symmetrical, diametrically opposed sidearm passageways, 24, 26 will have lengths of approximately 8.3 mm and diameters of approximately 3.2 mm and fluidly interconnecting with the intermediate passageway 18 at approximately the mid portion thereof; a second cylindrical section 28 will have a constant diameter of 4.7 mm and a length of 6.8 mm; and second exit funnel section 30 will have a height of approximately 64 mm tapering to an exit diameter of approximately 10.5 mm. When so constructed, the improved venturi apparatus is operative to substantially aerate wine, especially red wine, when a flow of liquid wine is merely passed through the venturi apparatus at atmospheric pressure and the consumer need only pour the wine from the bottle through a vertically oriented venturi apparatus and into a wine glass or other receptacle, such as a decanter. Such dimensions, however, are merely one example of how to construct the improved venturi apparatus invention for a specific application and by no means should be construed as any limitation thereof.

Moreover, the improved venturi apparatus 10, as will be readily understood by those skilled in the art, may be formed as part of a housing 12, as shown in FIG. 1, or may otherwise be incorporated as part of a fitting or incorporated as part of a tubular pipe structure. The improved venturi apparatus 10 is further preferably configured to assume a vertical orientation, to thus enable gravitational force to cause fluid to flow sequentially through the sections 14, 16, 18, 28 and 30, as shown. As will be readily understood, however, the improved venturi apparatus 10 may be configured to assume horizontal and angled configurations and further, may be operative to receive fluids that are pressurized.

Additional modifications and improvements of the present invention may also be apparent to those of ordinary skill in the art. Thus, the particular combination of parts and steps described and illustrated herein is intended to represent only certain embodiments of the present invention, and is not intended to serve as limitations of alternative devices and methods within the spirit and scope of the invention. As should again be reemphasized the improved venturi apparatus may be operative to be utilized as a stand alone device or otherwise incorporated as part of an integrated process and capable of widespread utilization as would be readily appreciated by one of ordinary skill.

What is claimed is:

1. An improved venturi apparatus for facilitating the mixture of a liquid and a gas, the apparatus comprising:

a. a first funnel section configured to be open to and in fluid communication with the atmosphere, and vertically aligned to receive the liquid due to the liquid being poured and subject to gravity and atmospheric pressure;

b. a first cylindrical section fluidly coupled to said first funnel section;

c. an intermediate passageway defining a compartment having a ceiling, floor and midsection, said intermediate, passageway having a ceiling diameter greater than a first cylinder diameter of said first cylindrical section, said, first cylindrical section ending at said ceiling;

d. at least one sidearm passageway fluidly connected to said intermediate passageway;

e. a second cylindrical section fluidly coupled with and extending from said floor of said intermediate passageway;

f. a second funnel section fluidly coupled to said second cylindrical section and vertically oriented with the first funnel section, the first and second cylindrical sections, and the intermediate passageway;

g. wherein said first funnel section, first cylindrical section, said intermediate passageway, said second cylindrical section and said second funnel section are operative to sequentially receive and define a fluid flow path for the liquid; and h. wherein said fluid flow path extending from said first cylindrical section to said ceiling of said intermediate passageway operatively introduces a decrease in pressure to the liquid passing therethrough and said at least one sidearm passageway is operative to introduce the gas into said intermediate passageway when said liquid passes therethrough at said decreased pressure.

2. The improved venturi apparatus of claim 1 wherein said venturi apparatus is encased within a housing.

3. The improved venturi apparatus of claim 1 wherein said venturi apparatus is encased within a fitting.

4. The improved venturi apparatus of claim 1 wherein said venturi apparatus is encased within a section of tubular pipe.

5. The improved, venturi apparatus of claim 1 wherein said ceiling diameter is about 30% greater than said first cylinder diameter.

6. The improved, venturi apparatus of claim 1 wherein said ceiling diameter is about 6.3 mm and said first cylinder diameter is about 4.7 mm.

7. The improved venturi apparatus of claim 1 wherein said at least one sidearm passageway is fluidly connected to said intermediate passageway at the midsection thereof at a point equidistant from said ceiling and floor of said midsection.

8. The improved venturi apparatus of claim 7 wherein said venturi apparatus includes first and second sidearm passageways that extend in diametrically opposed positions from said intermediate passageway.

9. The improved venturi apparatus of claim 1 wherein said ceiling diameter of said intermediate passageway is greater than the diameter of said second cylindrical section extending from the floor of said intermediate passageway.

10. The improved venturi apparatus of claim 1 wherein said liquid is caused to flow through said fluid flow path by gravitational force and air is caused to pass through said at least one sidearm passageway when said liquid passes through the intermediate passageway.

11. The improved venturi apparatus of claim 1 wherein said ceiling intermediate passageway is planar.

12. An improved venturi apparatus for facilitating the mixture of a liquid and a gas, the apparatus comprising:

a. a first funnel section having a first cylindrical section fluidly coupled thereto and extending downwardly therefrom, the first funnel section configured to be open to and in fluid communication with the atmosphere, and vertically aligned to receive the liquid due to the liquid being poured and subject to gravity and atmospheric pressure;

b. an intermediate passageway defining a compartment having a ceiling, floor and midsection, said ceiling of said intermediate passageway being fluidly coupled to and depending from said first cylindrical section, said ceiling of said intermediate passageway having a ceiling diameter greater than a cylinder diameter of said first cylindrical section;

c. at least one sidearm passageway fluidly connected to the midsection of said intermediate passageway;

d. a second cylindrical section fluidly coupled to and depending from floor of said intermediate passageway, said second cylindrical section having a second funnel section depending therefrom and fluidly coupled thereto; and e. wherein said first funnel section, first cylindrical section, said intermediate passageway, said second cylindrical section and said second funnel section have a vertical orientation and are operative to sequentially receive and define a fluid flow path for the liquid and said at least one sidearm passageway is operative to receive and transfer the gas to said intermediate passageway when said liquid passes therethrough.

13. The improved venturi of claim 12 wherein said ceiling of said intermediate passageway is planar.

14. The unproved venturi apparatus of claim 12 wherein said liquid is caused to flow through said fluid flow path by gravitational force and air is caused to pass through at least one sidearm passageway when said liquid passes through the intermediate passageway.

15. The improved venturi apparatus of claim 12 wherein said ceiling diameter is about 30% greater than said cylinder diameter.

16. The improved venturi apparatus of claim 1 wherein said ceiling diameter is about 6.3 mm and said cylinder diameter is about 4.7 mm.

17. A method of aerating wine, the method comprising:

disposing a venturi apparatus in vertical alignment with a receptacle such that a liquid flow path of the apparatus is substantially vertically aligned;

pouring wine from a bottle, the wine flowing vertically downward due to gravity, through an opening in a top of the venturi apparatus exposed to the atmosphere into a reservoir of the venturi apparatus at a beginning of the liquid flow path, the wine being subject to about atmospheric pressure in the reservoir;

continuing to dispose the apparatus such that the wine flows vertically downward from the reservoir;

decreasing pressure of the wine in a vicinity of an air intake;

drawing air through the air intake due to the pressure decrease;

mixing the wine with the air drawn through the air intake to form aerated wine; and continuing to dispose the apparatus in vertical alignment with the receptacle such that the aerated wine flows from the apparatus into the receptacle.

18. The method of claim 17 wherein decreasing the pressure of the wine occurs vertically above the air intake.

19. The method of claim 18 wherein decreasing the pressure of the wine comprises flowing the wine from a first passageway having a first cross- sectional area into a second passageway having a second cross-sectional area about 70% greater than the first cross-sectional area.

20. The method of claim 19 further comprising normalizing fluid flow of the aerated wine by flowing the aerated wine into a third passageway having a substantially uniform shape over its length and having a third cross-sectional area smaller than the second cross-sectional area.

* * * * *

US007614614C1

(12) EX PARTE REEXAMINATION CERTIFICATE (7880th)

United States Patent
Sabadicci et al.

(10) Number: US 7,614,614 C1
(45) Certificate Issued: Nov. 16, 2010

(54) VENTURI APPARATUS

(75) Inventors: Rio Sabadicci, Carlsbad, CA (US); Larry D. Nelson, Carlsbad, CA (US)

(73) Assignee: Area 55, Inc., Carlsbad, CA (US)

Reexamination Request:
No. 90/009,709, Mar. 22, 2010

Reexamination Certificate for:

| | |
|---|---|
| Patent No.: | **7,614,614** |
| Issued: | **Nov. 10, 2009** |
| Appl. No.: | **11/354,490** |
| Filed: | **Feb. 15, 2006** |

(51) Int. Cl.
*B01F 3/04* (2006.01)

(52) U.S. Cl. ..... 261/76; 261/DIG. 75; 426/474
(58) Field of Classification Search ..... 261/76
See application file for complete search history.

(56) References Cited

U.S. PATENT DOCUMENTS 4,595,121 A 6/1986 Schultz
5,293,912 A 3/1994 Wildash et al.
5,335,588 A 8/1994 Mahlich
6,568,660 B1 5/2003 Flanbaum

OTHER PUBLICATIONS

"Wine Breather", www.beer–wine.com, Mar. 19, 2010, pp. 1–3, Woburn, Massachusetts, USA.

*Primary Examiner*—Terrence R Till

(57) ABSTRACT

An improved venturi apparatus for facilitating the mixture of fluid substances. The apparatus preferably has first funnel section operative to receive a fluid and channel the same through a first cylindrical section or passageway. The first cylindrical section is fluidly connected to an intermediate passageway having a diameter larger than the first cylindrical section. At least one sidearm passageway is fluidly connected to the intermediate passageway into which at least one second fluid is introduced. The at least one sidearm passageway is preferably configured to fluidly interconnect with the intermediate passageway at approximately the medial portion of the intermediate passageway. Fluidly connected to the intermediate passageway is a second cylindrical section that is operative to direct the flow of the intermixed fluids to a second exit funnel section. The improved venturi apparatus is exceptionally efficient at drawing in a second fluid and effective in facilitating the mixture of two or more gasses, liquids or combinations thereof.

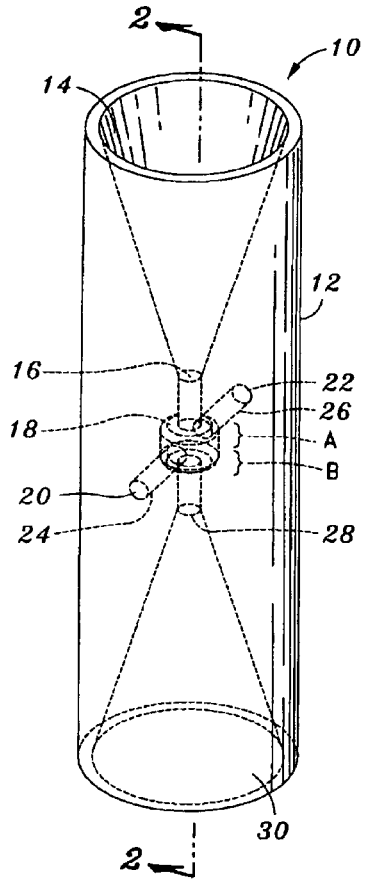

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 17 and 18 is confirmed.

Claims 1-16, 19 and 20 were not reexamined.

* * * * *